US007222573B2

(12) United States Patent
Pontieri

(10) Patent No.: US 7,222,573 B2
(45) Date of Patent: May 29, 2007

(54) AERODYNAMIC AIR GUN PROJECTILE

(76) Inventor: James M. Pontieri, 36291 Jared, Sterling Heights, MI (US) 48312

( * ) Notice: Subject to any disclaimer, the term of this patent is extended or adjusted under 35 U.S.C. 154(b) by 0 days.

(21) Appl. No.: 11/391,865

(22) Filed: Mar. 29, 2006

(65) Prior Publication Data

US 2007/0074637 A1 Apr. 5, 2007

Related U.S. Application Data

(60) Provisional application No. 60/667,516, filed on Apr. 1, 2005.

(51) Int. Cl.
*F42B 5/24* (2006.01)

(52) U.S. Cl. ..... 102/501; 102/524

(58) Field of Classification Search ..... 102/501, 102/502, 524; D22/115, 116
See application file for complete search history.

(56) References Cited

U.S. PATENT DOCUMENTS

| | | | |
|---|---|---|---|
| 517,560 | A | 4/1894 | Ashley |
| 838,511 | A | 12/1906 | Saunders |
| 1,447,478 | A | 3/1923 | Kosholiek et al. |
| 3,557,656 | A | 1/1971 | Precoul |
| 3,568,603 | A | 3/1971 | Vartanian |
| 3,649,020 | A | 3/1972 | Hall |
| D231,447 | S | 4/1974 | Abbott |
| 3,881,421 | A | 5/1975 | Burczynski |
| 4,005,660 | A | 2/1977 | Pichard |
| 4,048,922 | A | 9/1977 | Buljovcic |
| 4,136,616 | A | 1/1979 | Schirneker |
| 4,251,079 | A | 2/1981 | Earl et al. |
| 4,361,093 | A | 11/1982 | Saxby |
| 4,370,822 | A | 2/1983 | Rabino |
| 4,383,853 | A | 5/1983 | Zapffe |
| 4,413,564 | A | 11/1983 | Brown |
| 4,610,061 | A | 9/1986 | Halverson |
| 4,945,836 | A | 8/1990 | Michaels |
| 4,979,443 | A | 12/1990 | Rittel et al. |
| 4,986,251 | A | 1/1991 | Lilley et al. |
| 5,018,450 | A | 5/1991 | Smith |
| 5,131,123 | A | 7/1992 | Brooks |
| 5,150,909 | A | 9/1992 | Fitzwater |

(Continued)

FOREIGN PATENT DOCUMENTS

| | | |
|---|---|---|
| DE | 196 47 045 A 1 | 5/1998 |

(Continued)

*Primary Examiner*—Michelle Clement
*Assistant Examiner*—Benjamin P. Lee
(74) *Attorney, Agent, or Firm*—J. Gordon Lewis

(57) ABSTRACT

A projectile for an air arm is integrally formed from a single piece of dense malleable material formed as a body of revolution about a longitudinal axis having a head portion dimensioned for free sliding in the bore of an air arm and a skirt-like portion of frusto-conical form. The rearward end of the skirt portion is dimensioned to be in slight interference fit with the bore and the forward end is joined with the head portion to define a reduced diameter waist. The frustum is shell-walled, having a central recess opening to the rear and extending forwardly into the head portion. The head portion has a parabolically shaped outer surface which transitions smoothly into a hyperbolically shaped outer skirt surface for aerodynamic efficiency. Vanes are formed on the head portion to enhance in-flight spiraling rotation.

21 Claims, 5 Drawing Sheets

U.S. PATENT DOCUMENTS

| | | | | |
|---|---|---|---|---|
| 5,164,538 | A * | 11/1992 | McClain, III | 102/517 |
| 5,175,389 | A | 12/1992 | Kramer et al. | |
| 5,185,495 | A | 2/1993 | Petrovich et al. | |
| 5,193,517 | A | 3/1993 | Taylor et al. | |
| 5,339,743 | A | 8/1994 | Scarlata | |
| 5,353,712 | A | 10/1994 | Olson | |
| 5,385,100 | A | 1/1995 | Corzine et al. | |
| 5,471,719 | A | 12/1995 | Sawyers | |
| 5,515,787 | A | 5/1996 | Middleton | |
| 5,666,937 | A | 9/1997 | Mendoza-Orozco | |
| 5,725,179 | A * | 3/1998 | Gilman et al. | 244/3.24 |
| 5,967,916 | A | 10/1999 | Robeson | |
| 6,244,186 | B1 | 6/2001 | Pichard | |
| 6,526,893 | B2 | 3/2003 | May et al. | |
| 2002/0100389 | A1 | 8/2002 | May et al. | |
| 2002/0134273 | A1 * | 9/2002 | Mihaylov et al. | 102/439 |
| 2004/0237952 | A1 | 12/2004 | Maeda | |

FOREIGN PATENT DOCUMENTS

| | | |
|---|---|---|
| GB | 1 263 522 | 2/1972 |
| GB | 2 116 681 A | 9/1983 |
| GB | 2 153 983 A | 8/1985 |
| GB | 2 179 427 | 3/1987 |
| GB | 2 274 502 A | 7/1994 |
| GB | 2 307 033 A | 5/1997 |
| GB | 2 353 345 A | 2/2001 |
| JP | 2000-213897 | 8/2000 |
| JP | 2001041697 | 2/2001 |
| JP | 2001041698 | 2/2001 |
| WO | WO 02/059542 A2 | 8/2002 |

* cited by examiner

AERODYNAMIC AIR GUN PROJECTILE

RELATED PATENT APPLICATIONS

The present invention claims priority to provisional application U.S. Ser. No. 60/667,516, filed 1 Apr. 2005, entitled "Aerodynamic Air Gun Pellet".

TECHNICAL FIELD

The present invention relates to gas-propelled projectiles, such as pellets, which are intended to be expelled from air arms such as air pistols or air rifles, and particularly concerns a novel pellet configuration for achieving high muzzle velocities and superior uniformity of flight trajectory over long ranges.

BACKGROUND OF THE INVENTION

A projectile loaded into the barrel bore of a conventional air arm is propelled by the pressure of air which increases abruptly in the conduit leading to the breech as the piston is spring driven on release of the piston shaft. The energy stored in the spring is largely converted to work of compression performed as a nearly adiabatic process compressing the air ahead of the piston, but significantly large losses arise in the process of transferring kinetic energy of motion to the projectile from the compressed fluid.

Ideally, the projectile should be a body whose configuration forms a perfect gas seal in the barrel and provides a predetermined large initial resistance to being dislodged from rest in its initial, loaded position, which resistance should abruptly fall to zero once the breech pressure has reached a high value nearly equaling the peak gas pressure achieved during the piston stroke. Stated otherwise, the body should move without friction once the gas temperature has peaked, and should accelerate to maximum muzzle velocity while the breech pressure remains near or at its highest value.

In any practical barrel form the space behind the projectile is a storage vessel in which volume the entire compressed air charge is confined when the piston has been driven almost to the breech, at which time the projectile is about to be expelled. Consequently, the friction of the work of compression represented by the column of highly compressed air in the bore is not available for further acceleration of the projectile as a secondary piston. Accordingly, it will be seen that any improvement in muzzle velocity is to be attained only by avoiding losses occurring while the projectile is in the barrel.

Previously, a large number of projectile designs have been experimented with in attempting to increase the muzzle velocity. Current high-performance pellets are of "daibolo" form, i.e. they have a head portion of normal bore diameter, a reduced-diameter waist, and a flaring skirt after-portion comprising a hollow frusto-conical shell wall merging at its lesser diameter end with the head portion. Certain high-power air arms having precision rifled steel barrels are capable of accelerating the better projectile forms to muzzle velocities in the 680–780 feet per second range, excluding compression-ignition assist by ether or a hydrocarbon vapor released from the pellet.

The known forms of pellets are made from such materials and have their dimensions so chosen as to provide adequate frictional holding in the breech end of the barrel so that the inserted pellet will reliably remain stationary during barrel-closing and sighting, and so that a certain amount of drag resistance to movement is provided until the pressure has risen to several hundred pounds per square inch. Once this pressure is reached the forward movement of the pellet "grooves" the largest-diameter surface portions, which engage the barrel lands and the rifling grooves, thereby imparting rotary movement to the pellet so that it is expelled from the barrel with a high spin velocity advantageous to trajectory stability. Lead and lead alloys are cast or molded in dies to produce such pellets, after which careful selection and cushioned packaging are performed to ensure that the pellets are without deformation when they are to be fired.

In general, the best prior art pellets have a skirt margin which is relatively stiff and unyielding, so that insertion into the breech end of the barrel, even when the breech is tapered, requires firm pressure by the user's thumb to perform the initial swaging operation. While firm seating is achieved by such pellet forms, and a certain amount of initial build-up of gas pressure in the breech chamber is assured before the pellet breaks away from the static friction restraint, the pellet is not inherently self-aligning with the barrel axis, nor is the periphery of the skirt capable of being urged into such intimate engagement with the barrel bore and the rifling grooves as to avoid substantial "blow-by" of compressed air.

Certain air arms have a pellet-receiving breech and portion of the barrel wherein the bore has a diameter nearly equal to the diameter as measured between opposed rifling grooves, or even slightly larger than this diameter, so that the pellet skirt is insertable without appreciable swaging of the metal while the head portion is received in a normal bore diameter barrel portion.

While the pellet may be inserted in an initially coaxial relation to the barrel axis, as the pellet is driven forward the skirt is abruptly frictionally engaged by the reduced diameter barrel portion and remains briefly arrested until increasing air pressure drives it ahead, swaging the skirt periphery to form grooves. During this time the sealing action is imperfect which allows significantly large gas blow-by to occur, and further escape continues past the skirt margin throughout the pellet travel through the barrel.

U.S. Pat. No. 4,005,660 to J. Pichard describes a high velocity pellet for an air gun wherein the free marginal portion of the frusto-conical skirt has an inner rearward surface portion formed with a coaxial bevel so that the skirt margin tapers in thickness toward a thin rearward edge, and has a short axial length portion not longer than the internally beveled portion which flares rearwardly outwardly with a greater apical angle, the maximum diameter of the skirt periphery being so dimensioned that it is a light interference fit in a barrel diameter equal to the diameter measured across opposed rifling grooves.

In Pichard, the pellet is formed of a material such as lead or lead alloy preferably without hardening components and preferably a virgin metal which will swedge readily in its reduced thickness terminal region, enabling the skirt periphery to rapidly engage the barrel wall intimately upon rise of air pressure in the breech. When the pressure in the bore has reached its maximum value, which in well designed air arms occurs when the projectile moved only a few inches, the pellet is a freely-sliding but closely-fitted secondary piston, the skirt margin being molded to an axially-short annular ring portion of substantial constant axial length, the outer surface of which is engaged in close conformity to the transverse cross-sectional internal surface of the barrel, i.e. sliding along both the barrel lands and the bottoms of the rifling grooves. The remainder of the terminal frusto-conical portion is out of contact with the barrel. The relatively pliant terminal edge portion assures that the pellet axis coincides substantially with the barrel axis.

U.S. Pat. No. 5,150,909 to Fitzwater describes an air gun pellet comprising a spherical projectile removably retained on a skirt assembly, wherein the skirt assembly provides an arrangement for separating the projectile from the skirt assembly after the initial firing of the gun but before the projectile exits the barrel of the gun. In one version, the skirt assembly has a skirt body, with a shaft affixed to the skirt body. A projectile clutch assembly includes a clutch body and at least two clutch jaws disposed about the projectile. A retained device is disposed within the clutch body such that the projectile is retained within the clutch jaws. A conduit is disposed within the clutch body such that the shaft is capable of traversing through the conduit and propelling the projectile from the clutch jaws.

The Fitzwater device has a number of shortcomings. The release of the projectile from the skirt portion while within the barrel will result in appreciable loss of range due to premature blow-by of the compressed air around the projectile, which has a substantially smaller diameter than the internal diameter of the gun barrel. Additionally, the loss of contact of the pellet with rifling within the bore will adversely affect both range and accuracy, as will the round shape of the pellet. The multi-part structure of the Fitzwater device is expensive and prone to inadvertently separating prior to firing, resulting to jamming and mis-feeding of pellets within the air gun mechanism.

U.S. Pat. No. 4,251,079 to Earl et al. describes a pellet for an air gun which has a head portion made of metal or metal containing plastics material and a shank extending rearwardly from the head portion. A skirt portion is secured to the head portion by the shank. The skirt portion has at least two sections, which are larger in diameter than the head portion and is made of elastic plastic material, for slidably engaging the gun barrel bore surface. The head portion provides weight for the skirt portion during flight. As in the case of Fitzwater, the Earl device employs plastic to affect a seal of the compressed gasses during firing. The use of elastic materials such as plastic can result in blow-by, with resulting loss of range and accuracy. Furthermore the irregular shape of the Earl device will result in an irregular flight trajectory, with further loss of range and accuracy.

U.S. Pat. No. 6,526,893 B2 to May et al. describes polymer ballistic tip pellets including soft lead pellets with hard polymeric tips for use in air guns. The lead pellets have forwarded pointed tip portions made from a hard polymeric material. The tip portions can have hollow or solid heads. The hard tip in each of the pellets enables the pellet when fired from an air gun to pierce the fur and skin of small game animals, for example, before the lead portions of the head and skirt of the pellet begin to deform, imparting shock to the surrounding soft tissue, and shattering bone. Although the lead portion of the May design may operate in a similar manner as described in connection with the Pichard device, the two-piece design adds cost and complexity to the manufacturing process. Furthermore, any irregularities or misalignment of the lead portion and tip will result in an irregular trajectory with attendant loss of accuracy.

U.S. Pat. No. 3,649,020 to Hall describes an air gun projectile including a conventional air gun slug having a forward nose portion and a skirt portion flaring outwardly and rearwardly from a reduced diameter central portion. The nose portion is placed within the cylindrical bore of an impact-yielding cap. The cap has a circular front wall end and a rearwardly extending cylindrical skirt. The cap skirt is snugly received over the slug nose portion and the external diameter of the cap skirt is substantially equal to the diameter of the slug skirt at its widest point. Disposed within a hollow defined by the slug nose, cap front wall, and cap skirt is an indicator comprising a flash producing powder and Amorce mixture, and/or a solvent-based paint. Regarding trajectory and accuracy, the Hall device has many of the shortcomings of the other multi-part air gun pellets described herein above.

In summary, prior art pellets for air guns typically fall into two broad categories, those intended for target or non-lethal usage which have a blunt, non-penetrating head profile and remain largely intact after impact, and pellets useful for hunting which either have a projecting leading surface for high target penetration and/or features to produce substantial radial expansion or fragmentation upon contacting a target to maximize impact and soft tissue damage.

Enhancing projectile flight trajectory, and thus, range and accuracy, were immeasurably improved with the advent of rifled bores. The spiral grooves within the bore of the weapon initially impart a rotary motion component to the projectile as it accelerates down the barrel. Once discharged from the barrel, however, there is nothing other than inertia to sustain the rotary motion and it will be reduced somewhat over time due to air turbulence and drag. Thus, as it nears its impact point, its accuracy will be diminished.

To optimize flight characteristics of a projectile throughout its entire trajectory to the point of impact, means must be provided to sustain or even increase its rate of rotation. This is well known and practiced in gravity bombs and large caliber munitions, particularly those, which are chemically propelled in flight to enhance their range, such as rocket-propelled grenades and the like. Most typically, an empennage structure is added, including guide surfaces behind the projectile.

Axially directed through passages have been proposed in large caliber munitions for guidance purposes. These have the advantage of permitting internally disposed (and thus relatively protected) guide vanes to enhance rotation. U.S. Pat. No. 517,560 to Ashley describes a large caliber, armor-piercing projectile for smooth bore weapons having a central passage and internal spiral ribs, thought to enhance rotation in flight. Although the Ashley device may have utility for large caliber weapons, it has several shortcomings that render it inapplicable for smaller caliber applications. The relatively large passageway of the Ashley device results in the mass of the device being distributed externally, far from the central axis. Thus, any irregularities or asymmetries will divert the projectile from its intended trajectory. Secondly, and more importantly, simply reducing the scale of the Ashley device to a diameter typically employed in air arms would render any spiral enhancing effect negligible and probably decrease accuracy.

Although accuracy, range and flight/trajectory characteristics are desirable for any projectile, the aerodynamics of known prior art pellets for air guns is uniformly poor. This is believed to be largely due to the relatively small caliber sizes involved, and the fact that air arms tend to be in the lower end market and, thus, their consumables are extremely cost sensitive. Little or no thought has been given to streamlining the pellet profile to maximize its in-flight aerodynamic behavior. Most known designs have blunt leading surfaces and/or irregular surface features and abrupt contours which produce turbulence in the adjacent air stream and range reducing drag.

Another shortcoming of known pellets for air arms results from lack of rigorous design methodologies in optimizing their ballistic characteristics. Most pellet designs comprise nothing more that an inartistic cylindrical lump of lead with a short conical tail. Little or no thought has been given to precise placement of the center of gravity of the projectile as an essential element of maximizing in flight stability, and thus accuracy and shot-to-shot repeatability.

It is, therefore, a primary object of the present invention to provide an improved aerodynamic projectile for an air arm which overcomes known shortfalls of existing devices without adding to part count, manufacturing complexity or cost.

SUMMARY OF THE INVENTION

Generally, the present invention fulfills the forgoing needs by providing a highly aerodynamic air gun projectile formed from a dense, malleable material and includes surface features, which enhance in-flight stability and spiral motion, and thus, trajectory, range and accuracy.

According to one embodiment of the invention, a projectile for an air arm is molded as a body of revolution about a longitudinal axis comprising a head portion which is dimensioned for free sliding in a bore of an air arm, and a skirt-like portion of frusto-conical form of which the rearward most end is dimensioned to be in interference fit with the air arm bore. The forward most end of the skirt-like portion is joined with the head portion in a reduced diameter waist. The frustum is shell-walled and has a central recess, which opens to the rear and extends forwardly into the head portion. The projectile has an external surface form, which is characterized by a parabolic-like head, which smoothly transitions axially into a hyperbolic-like skirt. This arrangement provides the advantage of a simple unified one-piece construction for an air arm projectile which is minimally deformed during the firing process to minimize blow-by of compressed air and which is aerodynamically streamlined to maximize range, accuracy and shot to shot repeatability.

According to another aspect of the invention, means are provided which induce rotation of the projectile about its axis as it traverses a line of trajectory after being discharged from the air arm. This feature has the advantage of imparting a spiral motion to a projectile fired from a smooth bore air arm and effecting a continued or increasing rate spiral motion to the projectile fired from a rifled air arm. In both cases, the present invention has proven to materially increase range and accuracy.

The means operative to induce continued or increasing in-flight rotational rate preferably includes one or more air deflecting vanes, which are formed symmetrically on the outer surface of the head portion of the projectile. Each vane extends axially in a helix-like configuration for substantially the entire axial extent of the head portion. This arrangement employs the largely laminar airflow over the leading and side edges of the head portion of the projectile to create tangentially directed reaction forces to increase and maintain the spin rate of the projectile.

The abovementioned vanes can be either incused within the head portion or raised above the nominal surface of the head portion, or both. Although the incused approach is preferred due to its more robust design and resistance to handling damage or deformation, the raised vane approach may be preferable in some applications inasmuch as it is believed to produce a more pronounced in-flight spiraling effect. The incused approach has a separate and distinct advantage of defining separation or fragmentation patterns, which, upon impacting a target, cause the projectile to predictably deform or disintegrate.

The vanes can preferably be disposed with a constant characteristic pitch, or, alternately, with a varying pitch, which increases with rearward extension of the vanes. Furthermore, the vanes can be shaped to be circumferentially symmetrical and/or asymmetrical in cross-section. Also, the vanes can be notch shaped, comprising substantially planar sidewalls and/or can have curvilinear sidewalls. This arrangement allows for application specific design variations, which can be selected after empirical development and testing.

According to another aspect of the invention, the vanes can also extend axially along at least a portion of the outer surface of the skirt portion of the projectile adjacent its waist. This arrangement is believed to reduce turbulent airflow adjacent the waist of the skirt portion, and thereby enhance laminar flow, reducing overall drag and increasing range of the projectile.

According to yet another aspect of the invention, the projectile is shaped to effectively position its center of gravity along its axis of symmetry within its head portion axially intermediate the leading and trailing ends of its vanes. This arrangement minimizes off-axis "dithering" in flight, increasing range and accuracy.

According to still another aspect of the invention, the forward end of the skirt portion is conjoined with the head portion of the projectile to form a radially outwardly facing guide surface. The rearward end of the skirt portion forms a radially outwardly facing rear guide surface. The front and rear guide surfaces cooperate to ensure precise concentric installation of the projectile in the breech of the air arm and, upon firing, to maintain the projectile in precise axial alignment as it traverses the bore of the associated air arm.

According to still yet another aspect of the invention, the axial length of the skirt portion is equal to or greater that the axial length of the head portion of the projectile. The extended length of the skirt portion allows a reduction of its overall mass and a resulting further forward placement of the center of gravity of the projectile. This further improves range and accuracy.

These and other features and advantages of this invention will become apparent upon reading the following specification, which, along with the drawings, describes preferred and alternative embodiments of the invention in detail.

BRIEF DESCRIPTION OF THE DRAWINGS

The present invention will now be described, by way of example, with reference to the accompanying drawings, in which.

Although the drawings represent embodiments of the present invention, the drawings are not necessarily to scale and certain features may be exaggerated in order to better illustrate and explain the present invention. The exemplification set forth herein illustrates an embodiment of the invention, in one form, and such exemplifications are not to be construed as limiting the scope of the invention in any manner.

DESCRIPTION OF THE PREFERRED AND ALTERNATIVE EMBODIMENTS

The present invention is intended for application with small caliber air powered arms such as air rifles and air hand guns, which can be of the pump type in which a charge of pressurized air is generated by a mechanism integrated into the weapon's structure adjacent its breech and is effective for powering a single shot, or, alternatively, one which employs a disposable, pre-pressurized air cylinder, which can power a number of successive shots.

Figure 1:
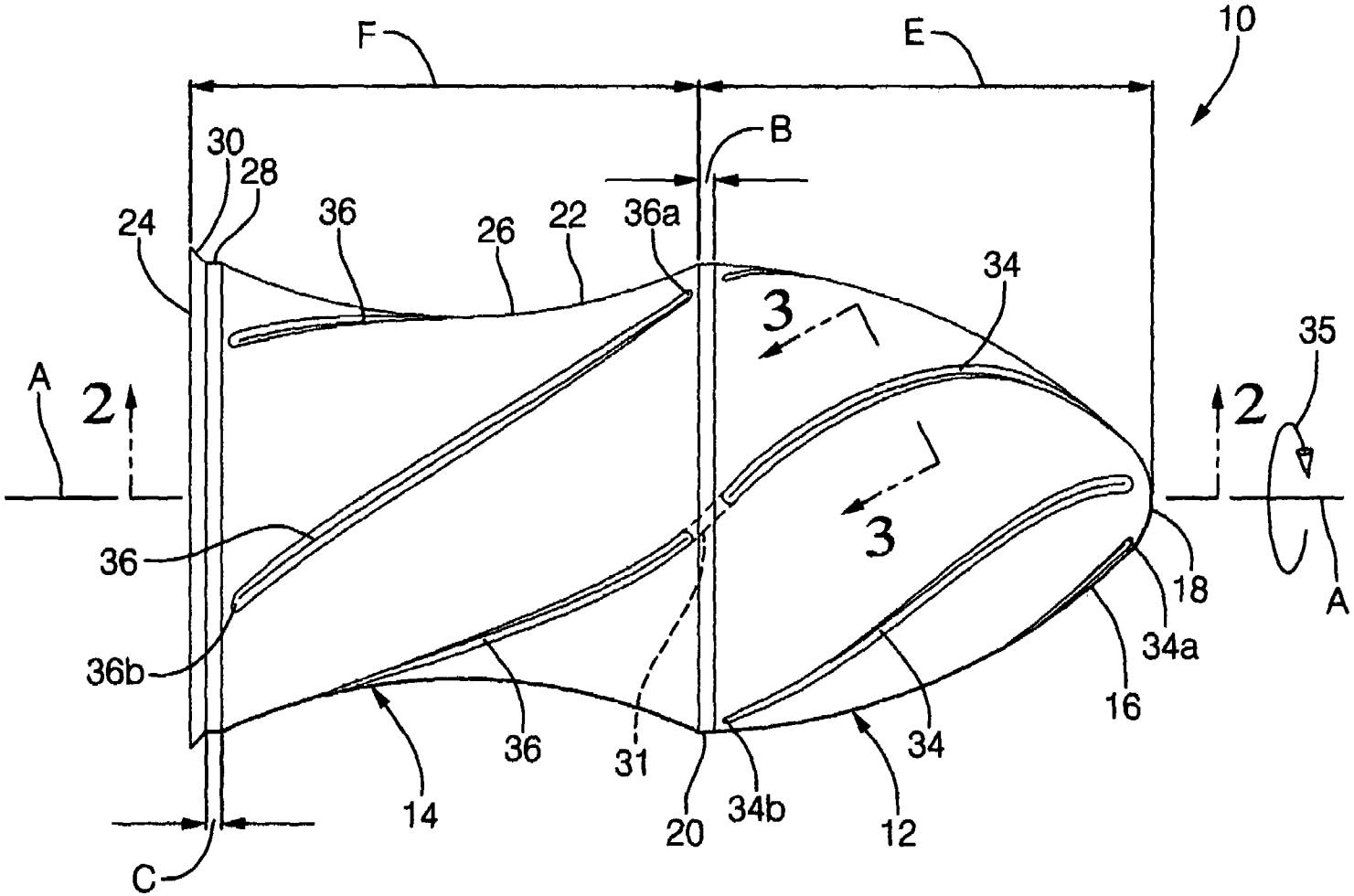
FIG. 1, is a side plan view of an air gun pellet reflecting the preferred embodiment of the invention.

Referring to FIG. 1, a pellet or projectile, indicated generally at 10, embodies the preferred embodiment of the present invention. The projectile 10 has a head portion 12 and a skirt portion 14 which are integrally formed, such as by casting, of a dense malleable material such as lead or a lead alloy. In consideration of alleged dilatory long term adverse environmental effects of lead, it is contemplated that other biodegradable, non-toxic materials can be substituted without departing from the spirit of the invention.

The composition of material employed to form projectile may comprise any dense particulate filler including pulverulent lead and lead alloys, particulate-lead sulfide (galena), bismuth, tantalum, nickel and copper, or alloys thereof, and even magnetite. As resinous binders a large range of thermoplastic and/or thermosetting resins may be incorporated, preferably in a minor weight percentage. Polyethylene and polypropylene will generally be chosen for lowest cost. However, for lowest friction drag, the preferred resin binder would be polytetrafluoroethylene, although incorporation of fillers therewith requires small particle dimensions of both constituents. The molding of such compositions is carried out conventionally in sectional molding dies.

Alternately, frangible projectile designs of press-formed, non-toxic powdered metal materials can also be successfully applied in practicing the present invention. These are particularly advantageous for use in indoor firing ranges where environmental concerns are particularly acute, and where airborne dust particles from disintegrated pellets or projectiles must be filtered/gathered. Such frangible projectile designs also enhance safety for the operator and bystanders inasmuch as ricocheting projectiles or fragments are minimized.

The diameter of the head portion 12 is preferably chosen as to be a free sliding fit along the barrel bore. For example, the clearance on each side of the head portion 12 at its point of maximum diameter should be of the order of a small fraction of 1 mm in small-bore guns such as 4.5 mm and 5.6 mm air arms. A suitable head diameter for 4.5 mm air arms is believed to be 4.2 mm.

The overall shape of the projectile 10 is configured to maximize its aerodynamic properties, i.e. to minimize parasitic drag and trajectory disruptive turbulence during flight. The head portion 12 of the projectile 10 has a leading or outer surface 16 of elongated parabolic shape, which is aligned on an axis (designated A—A) of symmetry and extends from a blunted nose portion 18 to a transition region 20. Transition region 20 is a substantially concentric, radially outwardly facing, axially abbreviated cylindrical surface, having an axial dimension designated "B", which is herein below referred to as a forward guide surface. The skirt portion 14 has an outer surface 22 of elongated parabolic shape, which extends axially from transition region 20 to its truncated trailing edge 24. Trailing edge 24 is normal to axis A—A.

The forward end of skirt portion 14 is integrally formed and is in register with the transition region 20 to provide a smoothly contoured overall outer surface of projectile 10 that extends continuously from nose portion 18 to the trailing edge 24 and avoids discontinuities. In flight, this shape maximizes the efficient laminar flow of air adjacent the surface of the projectile, and thereby minimizes drag inducing turbulent flow and resulting vortices.

The rearward end of the outer surface 22 of skirt portion 14 transitions from a central, reduced diameter waist portion 26, to a rearward guide surface 28 and an abutment surface 30. Rearward guide surface 28 has an axial dimension designated "C" and is registered with forward guide surface 20 and is of the same nominal diameter and axial length. The abutment surface 30 ramps radially outwardly slightly beyond guide surfaces 20 and 28. Outer surface 22 of skirt portion 14 smoothly transitions radially inwardly from both guide surfaces 20 and 28. With the exception of the abutment surface 30, all surface portions defined by the projectile are radially inward of guide surfaces 20 and 28.

In application, guide surfaces 20 and 28 are dimensioned to assume a slip fit interface with the bore, or the inner surfaces of the riflings of the associated air arm. Thus, when inserted into the breech of the air arm, the projectile 10 slips smoothly and precisely into the bore, with the guide surfaces ensuring that the axis X—X of the projectile 10 is aligned with the axis (not illustrated) of the air arm. Axial insertion continues until the abutment surface 30 contacts the leading edge of the breech (or riflings), and is thereafter prevented from further axial displacement. Thus positioned, the projectile is ready for breech closure and firing.

Upon firing of the air arm, the high pressure within the breech urges the projectile outwardly through the bore. The pressure will build until sufficient to deform the material within the projectile defining the abutment surface 30. At this point, the projectile is released and begins accelerating down the barrel. The deformation process will continue, effectively sealing the trailing edge 24 of the projectile 10 with the bore of the air arm to prevent "blow-by", as described herein above. To assist the reader in developing a better understanding of the dynamics of the firing process, reference should be made to U.S. Pat. No. 4,005,660 to Pichard, the teachings and specification of which are incorporated herein by reference.

Figure 2:
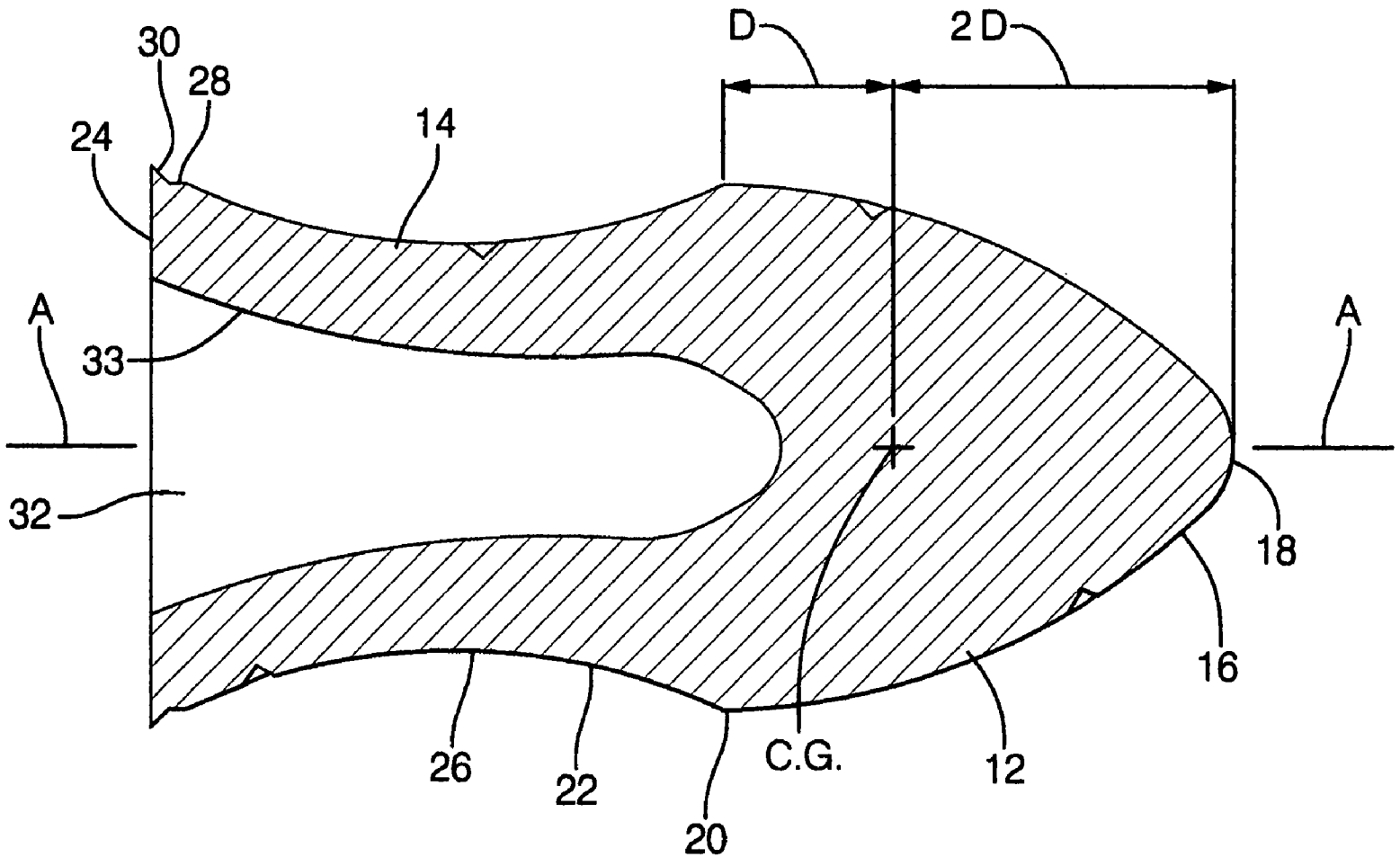
FIG. 2, is a cross-sectional view taken on lines 2—2 of FIG. 1.

Referring to FIG. 2, the internal details of the projectile 10 are illustrated. The skirt portion 14 is "shell-walled", defining a central recess 32, which opens to the rear through trailing edge 24 and extends forwardly into the head portion 12. As with the other features of the projectile, the recess 32 is concentrically arranged along axis A—A to ensure precise symmetry, and thus, balance of the projectile, to maximize its ballistic characteristics. Furthermore, recess is dimensioned and its extension into the head portion 12 is designed to position the overall center of gravity/mass (C.G.) of projectile 10 precisely on axis A—A, axially intermediate nose portion 18 and forward guide surface 20. Specifically, it is believed that positioning the C.G. an axial distance dimension "D" forward of the front guide surface 20 and an axial dimension "2D" behind nose portion 18 will minimize dither during flight. For any given profile of projectile 10, the positioning of the C.G. can be adjusted by simply reshaping the recess. The hollow interior space within recess 32 comprises a generally cylindrical bore 33 which extends entirely through the skirt portion 14 and communicated with the hollow interior of the skirt portion, which is of frusto-conical form.

The skirt wall is of a somewhat thicker cross-section compared to a conventional Diablo form, which is typically ribbed to resist bulging under internal pressure.

Referring to FIG. 1, the relative axial lengths of the head portion 12, designated dimension "E", and the skirt portion, designated dimension "F", are believed critical to overall aerodynamic efficiency. Preferably, dimension F will equal or exceed dimension E.

The present invention includes means, which induce post-firing rotation of the projectile 10 about axis A—A to enhance range, accuracy and repeatability. This means comprises one or more vanes 34 formed on the outer surface of the projectile 10 which impinges laminar air flow in flight to impart tangential force vectors at the outer surface to create or sustain spin, or spiral motion, as indicated by spiral arrow 36. Preferably, a plurality of vanes 34 are symmetrically formed on the surface 16 of head portion 12 to maximize their effect and to balance any lateral forces. Vanes can be configured to affect either right or left-handed spiral motion. Left hand spiral motion is illustrated in this application. Either spin direction can be employed in smooth barrel air arms. However, in air arms equipped with rifling within their bore, the vanes 34 must be configured to affect rotation in the same direction as does the rifling.

An additional set of vanes 36 are formed on outer surface 22 of skirt portion 14. Each vane 34 extends axially from a forward end 34*a* just behind nose portion 18 to a rearward end 34*b* just in front of forward guide surface 20. Likewise, each vane 36 extends axially from a forward end 36*a* just behind forward guide surface 20 to a rearward end 36*b* just in front of rearward guide surface 28. Whatever configuration is adopted for vanes 34 and 36, it is essential that their effective radial height never exceed that of the guide surfaces 20 and 28.

In an additional design, vane 34 can be axially extended through the region of guide surface 20 as depicted by phantom line vane extension 31. This will circumferentially segment guide surface 20 and should improve overall flight performance of the projectile 10.

In still another alternative design, vane extension 31 can interconnect vanes 34 and 36 to provide a single composite vane which extends axially from nose portion 18 to rearward guide surface 28.

Figure 9:
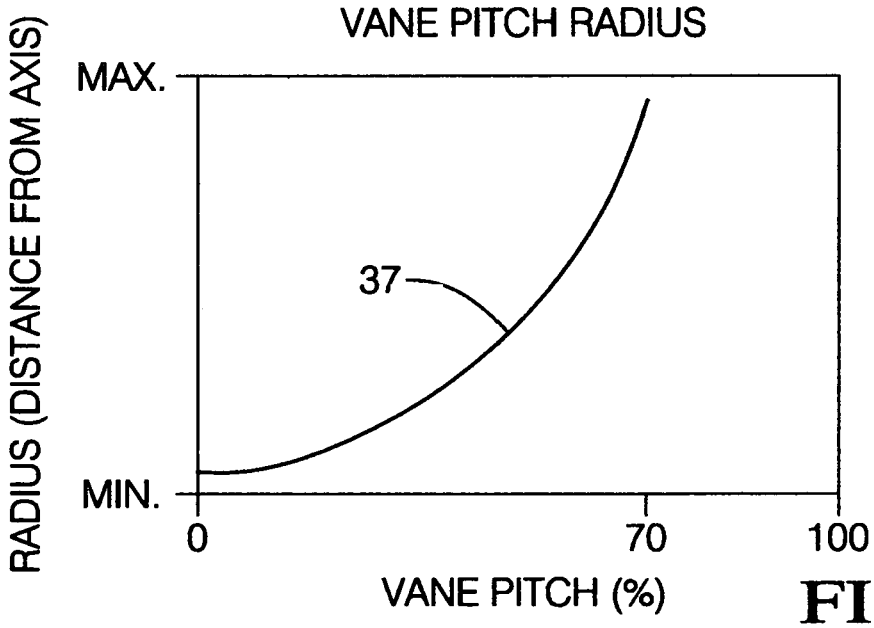
FIG. 9, is a graphical representation of the variation of degree of vane pitch with increasing radius.

Vanes 20 and 28 are formed as a variable radius helix, which can have a constant or varying characteristic pitch. It is believed that a vane pitch, which varies or transitions smoothly, i.e. without vortex inducing abrupt or step changes, maximizes the laminar airflow and, thus, aerodynamics of the projectile 10. Referring to FIG. 9, an example characteristic 37 of a varying vane pitch is graphically depicted. In this example, the pitch approximates a "0%" rate near the nose portion 18 and increases gradually in the rearward axial direction, ending at an approximately "70%" adjacent the forward guide surface. This accommodates the increasing effective diameter of the underlying surface 16 of the head portion 12.

Figure 3:
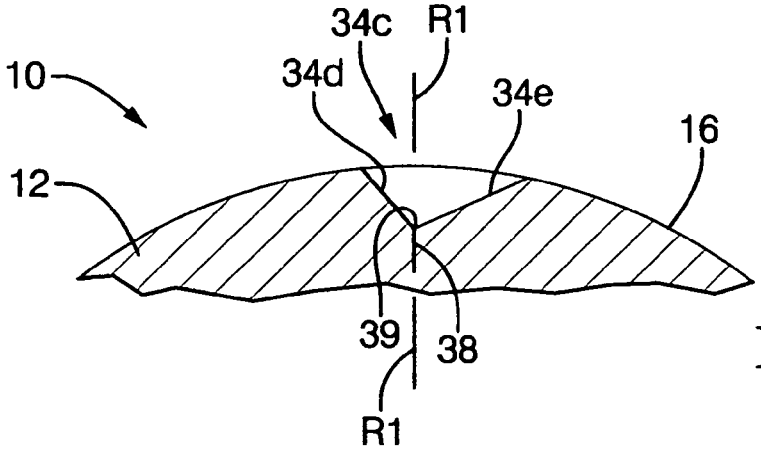
FIG. 3, is a broken, cross-sectional view, on an enlarged scale, of an air gun pellet head surface feature, taken on lines 3—3 of FIG. 1.

Referring to FIG. 3, a broken cross-section of a portion of head portion 12 of projectile 10 illustrates one embodiment of an "incused" or inwardly formed vane 34*c*. The configuration of vane 34*c* is substantially constant through its entire axial length. Vane 34*c* is defined by a notch-like recess formed by a first planer surface 34*d* which is offset from the nominal radial line R1—R1 intersecting axis A—A by a first angle, and a second planar surface 34*e* which is offset from radial line R1—R1 by a second, substantially different angle. This arrangement creates an asymmetry, which can enhance the aerodynamic performance of the projectile 10.

A crack-like fracture line 38 can be formed in a trench 39 at the intersection of surfaces 34*d* and 34*e*, which extends continuously or intermediately along vane 34*c*. Fracture line 38 facilitates a predictable radial distension, deformation or disintegration of the projectile 10 upon impact with a target.

Figure 4:
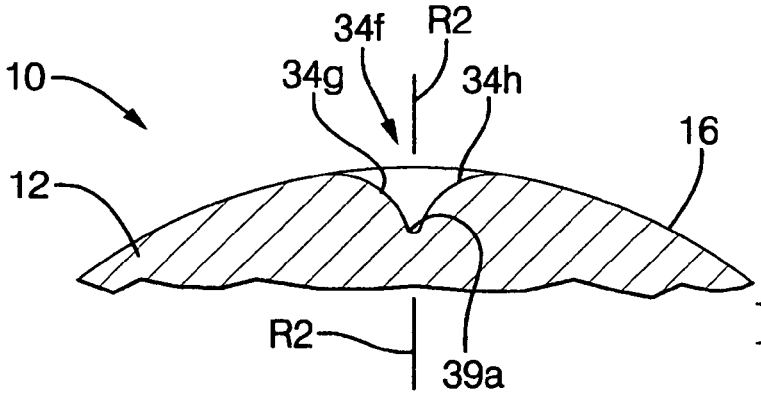
FIG. 4, is a broken, cross-sectional view, on an enlarged scale, of an alternative pellet head surface feature, similar to that of FIG. 3.

Referring to FIG. 4, a broken cross-section of a portion of head portion 12 of projectile 10, a variation of an incused vane 34*f* is illustrated. The configuration of vane 34*f*, as in the case of vane 34*c*, is substantially constant through its entire axial length. Vane 34*f* is defined by a notch-like recess formed by first and second convex curvilinear surfaces 34*g* and 34*h* intersecting in a rounded trench 39*a*, which are mirror images of one another and equally offset from radial line R2—R2. This arrangement creates a symmetrical vane, which is in some applications is preferential for use with projectile 10.

Figure 5:
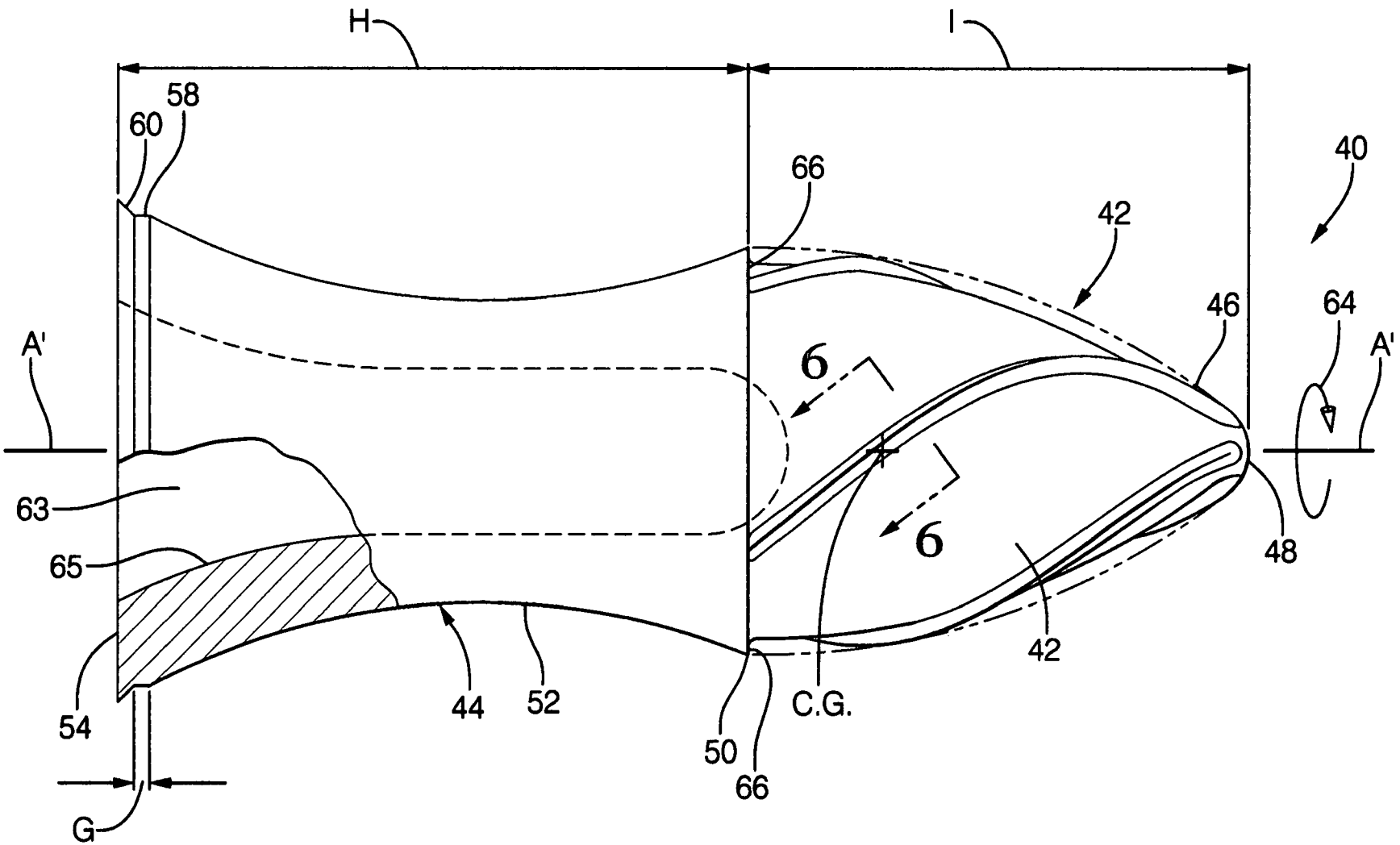
FIG. 5, is a combination side plan and cross-sectional view of an air gun pellet reflecting an alternative embodiment of the invention.

Referring to FIG. 5, an alternative embodiment of a projectile 40 is illustrated. Projectile 40 has a head portion 42 and a skirt portion 44 which are integrally formed. As in the case of the projectile 10 illustrated in FIGS. 1 and 2, the overall shape of projectile 40 is configured to maximize its aerodynamic properties. The head portion 42 of projectile 40 has a leading or outer surface 46 of elongated parabolic shape, which is aligned with an axis (designated X'–X') of symmetry and extends from a blunted nose portion 48 to a transition region 50. Transition region 50 is a substantially concentric, radially outwardly facing, circumferential edge surface, which herein below is referred to as a guide edge. The skirt portion 44 has an outer surface 52 of elongated parabolic shape, which extends axially from transition region 50 to its truncated trailing end surface 54. The trailing end surface 54 is normal to axis A'—A'.

The skirt portion 44 of projectile 40 is shell-walled, defining a central recess 63, which opens to the rear through trailing edge 54 and extends forwardly into the head portion 42. The recess 63 is concentrically arranged along axis A'—A', to ensure precise symmetry, and thus, balance of the projectile, to maximize its ballistic characteristics. Furthermore, it is employed to position the center of gravity/mass of projectile 40 as described herein above in connection with the embodiment of FIGS. 1 through 5. The hollow interior space within recess 63 comprises a generally cylindrical bore 65 which extends entirely through the skirt portion 44 and communicated with the hollow interior of the skirt portion, which is of frusto-conical form.

The forward end of skirt portion 44 is integrally formed and is in register with the transition region 50 to provide a smooth contoured overall outer surface of projectile 40 that extends continuously from nose portion 48 to the trailing edge 54 and avoids discontinuities. In flight, this shape maximizes the efficient laminar flow of air adjacent the surface of the projectile, and thereby minimizes drag inducing turbulent flow and resulting vortices. The present embodiment entirely eliminates even the slight discontinuities attributable to the forward guide surface 20 of the preferred embodiment of the invention.

The rearward end of the outer surface 52 of skirt portion 44 transitions from a central, reduced diameter waist portion 56, to a rearward guide surface 58 and an abutment surface 60. Rearward guide surface 58 has an axial dimension designated "G" and is registered with forward guide edge 50 and is of the same nominal diameter. The abutment surface 60 ramps radially outwardly slightly beyond guide surfaces 50 and 58. Outer surface 52 of skirt portion 44 transitions radially inwardly from both guide surfaces 50 and 58. With the exception of the abutment surface 60, all surface portions defined by the projectile are radially inward of the guide surfaces 50 and 58.

The abutment surfaces 30 and 60 of the two embodiments are pictorially exaggerated for the sake of clarity of understanding. In practice, they are proportionally much smaller. Furthermore, upon firing, the material forming the abutment surfaces 30 and 60 is deformed within the breech of the air arm to a much more streamlined profile which is largely radially aligned with adjacent rear guide surfaces 28 and 58, respectively.

The relative axial lengths of the head portion 42, designated "I", and the skirt portion 44, designated "H", are believed critical to overall aerodynamic efficiency. In this embodiment, dimension H substantially exceeds dimension I. It is believed that as the value of dimension H approaches 1½ the value of dimension I, the overall shape approaches a true "recurved" profile of approximately equal periods. Obviously, there must be weight and overall package size tradeoffs with aerodynamic efficiency.

The positioning of the center of gravity/mass (C.G.) of projectile 40 is made in accordance with the above teachings regarding the embodiment of the invention described in connection with FIGS. 1–4. Furthermore, the operation of projectile 4, upon firing and subsequently during flight, is identical in all material respects to the preferred embodiment of the invention, with the sole exceptions expressly set forth herein. The longer skirt portion 44 in proportion to the head portion 42 is believed to further reduce in flight dither.

One or more vanes 62 formed on the outer surface of the projectile 40 impinges largely laminar airflow in flight to impart tangential force vectors at the outer surface to create or sustain spin, or spiral motion, as indicated by spiral arrow 64. Preferably, a plurality of vanes 62 are symmetrically formed on the surface 46 of the head portion 42 to maximize their effect and to balance any lateral forces which could misdirect the flight path of the projectile 40. An additional set of vanes (not illustrated) could, alternatively, be formed on the outer surface 52 of the skirt portion 44.

Vanes 62 are formed as a variable radius helix, which can have a constant or varying characteristic pitch. Preferably, they are configured as depicted by characteristic 37 of FIG. 9 described herein above. Each vane 62 extends axially from a forward end 62*a* just behind nose portion 48 to a rearward end 62*b* which transitions into a ramp surface 66 forming guide edge 50. Both ends 62*a* and 62*b* are transitioned using large radiuses to minimize any resulting air turbulence.

Figure 6:
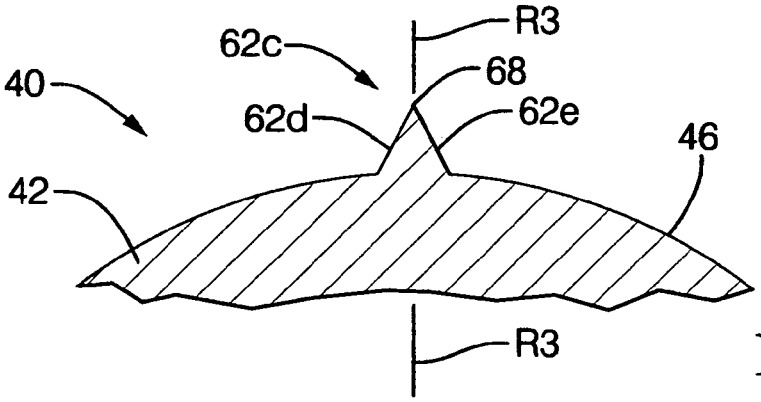
FIG. 6, is a broken, cross-sectional view, on an enlarged scale, of an air gun pellet head surface feature, taken on lines 6—6 of FIG. 5.

Referring to FIG. 6, a broken cross-section of a portion of head portion 42 of projectile 40 illustrates one embodiment of a "raised" or radially outwardly extending vane 62*c*. The configuration of vane is substantially constant through its entire axial length. Vane 62*c* is defined by an upstanding ridge defined by a first planar surface 62*d* which is offset from the normal radial line R3—R3 intersecting axis A'—A' by a first angle, and a second planar surface 62*e* which is symmetrically offset from radial line A'—A' by the same angle. This, surfaces 62*d* and 62*e* are largely mirror images of one another, intersecting at a common apex 68. This arrangement creates a symmetrical vane, which is in some applications preferential for use with projectile 40.

Figure 8:
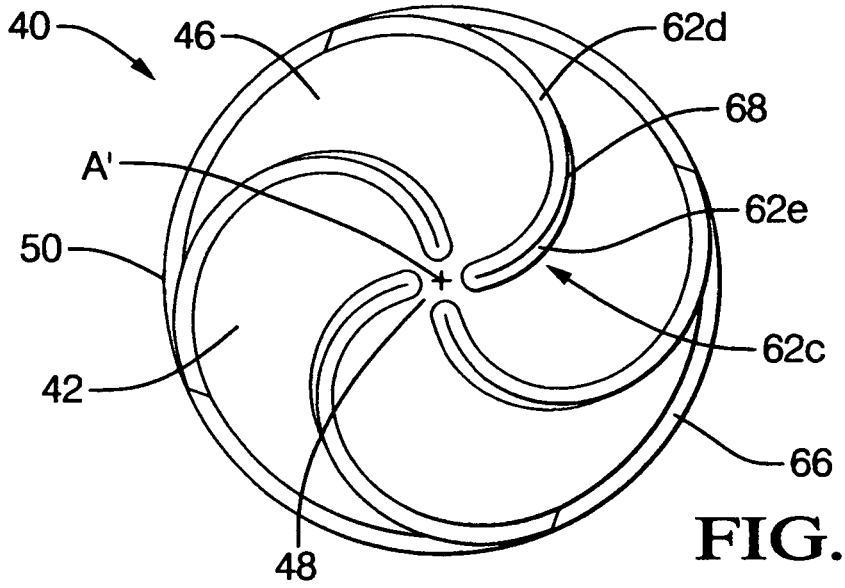
FIG. 8, is a front plan view of an air gun pellet reflecting the alternative embodiment of the invention of FIG. 5.

Referring to FIG. 8, a front plan view of projectile 40 illustrates an example of the arrangement of vanes 62*c* circumferentially about the surface 46 of head portion 42. It is contemplated that more or fewer vanes 62*c* can be employed without departing from the spirit of the present invention.

Figure 7:
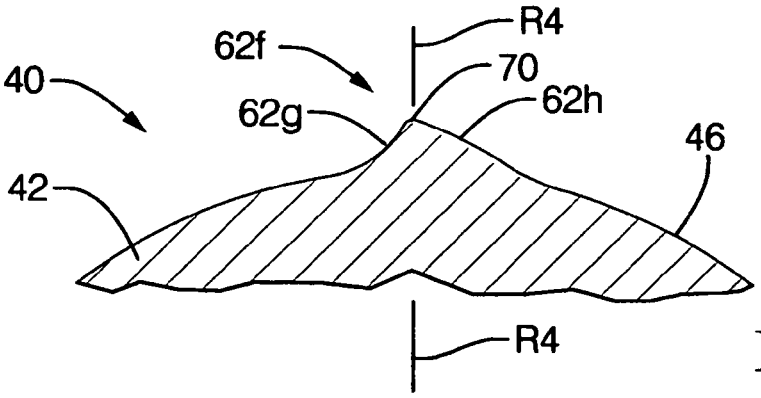
FIG. 7, is a broken, cross-sectional view, on an enlarged scale, of an alternative pellet head surface feature, similar to that of FIG. 6.

Referring to FIG. 7, a broken cross-section of a portion of head portion 42 of projectile 40, a variation of a raised vane 62*f* is illustrated. The configuration of vane 62*f*, as in the case of vane 62*c*, is substantially constant through its entire axial length. Vane 62*f* is defined by an upstanding ridge formed by a first generally concave curvilinear surface 62*g*, and a second generally convex curvilinear surface 62*h*. Surfaces 62*g* and 62*h* intersect at a rounded apex 70. Using large radiuses, vane 62*f* surfaces 62*g* and 62*h* are tapered or "feathered" to smoothly merge with the adjoining surface portions of surface 46 of head portion 42. Surfaces 62*g* and 62*h* have different shapes and set angles to establish an asymmetrical configuration, which can enhance the aerodynamic performance of the projectile 40. Whatever configuration is adopted for vanes 62*c* and 62*f*, it is essential that they never extend radially outwardly of the guide surfaces 50 and 58.

As a variant to the above described embodiments, forward guide edge 50 could be eliminated, at least for purposes of a guide surface, and the outwardly projecting vanes 62*c* or 62*f* extended radially readwardly past transition region 50. Insodoing, the apexes 68 of vanes 62*c*, or alternatively, the apexes 70 of vanes 62*f* can cooperate to provide an equivalent function to the forward guide surface for a smooth bore air arm.

Figure 10:
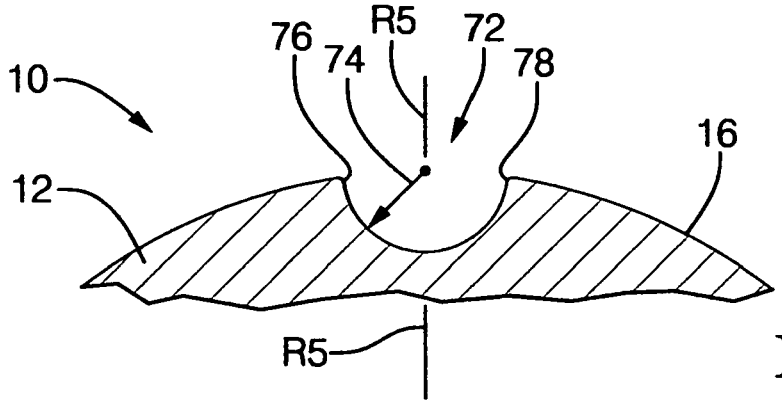
FIG. 10, is a broken, cross-sectional view, on an enlarged scale, of an air gun pellet head surface reflecting an alternative embodiment of the invention.

Referring to FIG. 10, a broken cross-section of a head portion 12, still another variation of an incused vane 72 is illustrated. The configuration of vane 72, as in the cases of vanes 34*c* and 34*f* in FIGS. 6 and 7, respectively, is substantially constant through its entire axial length. Vane 72 is defined by a semi-circular notch-like recess having a constant radius 74 and which smoothly transitions with leading surface 16 via smaller radaii 76 and 78. This arrangement provides a symmetrical vane 72 distributed about radial line R5—R5. This embodiment is considered to be the easiest to produce.

The present invention has been described with reference to certain exemplary embodiments thereof. However, it will be readily apparent to those skilled in the art that it is possible to embody the invention in specific forms other than those of the exemplary embodiments described above. This may be done without departing from the spirit of the invention. The exemplary embodiments are merely illustrative and should not be considered restrictive in any way. The scope of the invention is defined by the appended claims and their equivalents, rather than by the preceding description.

It is to be understood that the invention has been described with reference to specific embodiments and variations to provide the features and advantages previously described and that the embodiments are susceptible of modification as will be apparent to those skilled in the art.

Furthermore, it is contemplated that many alternative, common inexpensive materials can be employed to construct the basic constituent components. Accordingly, the forgoing is not to be construed in a limiting sense.

The invention has been described in an illustrative manner, and it is to be understood that the terminology, which has been used is intended to be in the nature of words of description rather than of limitation.

Obviously, many modifications and variations of the present invention are possible in light of the above teachings. It is to be understood that the invention extends to pellet or projectile forms of any caliber, in which the compressed air or gas driving system accelerates the projectile to a velocity in the subsonic range. The primary utility of the projectiles is in the competitive sport field where highly uniform muzzle velocity and enhanced trajectory and range is an advantage. It is therefore, to be understood that within the scope of the appended claims, wherein reference numerals are merely for illustrative purposes and convenience and are not in any way limiting, the invention, which is defined by the following claims as interpreted according to the principles of patent law, including the Doctrine of Equivalents, may be practiced otherwise than is specifically described.

The invention claimed is:

1. In a projectile for an air arm molded as a body of revolution about a longitudinal axis comprising a head portion dimensioned for free sliding in the bore of an air arm and a skirt portion of frusto-conical form of which the rearward end is dimensioned to be in interference fit with said bore and the forward end is joined with the head portion in a reduced diameter waist, the frustum being shell-walled and having a central recess opening to the rear and extending forwardly into the head portion, an improvement wherein said projectile has an external surface form characterized by a parabolic head which smoothly transitions axially into a hyperbolic skirt, said projectile further comprising one or more vanes formed substantially symmetrically on the outer surface of said head portion, each vane extending axially in a helix configuration with a characteristic pitch which varies along the axial extent thereof.

2. The air arm projectile of claim 1, wherein said vanes are operative to induce continued rotation of said projectile about its axis as it traverses a line of trajectory after being discharged from said air arm.

3. The air arm projectile of claim 1, wherein said vanes extend substantially the entire axial extent of said head portion.

4. The air arm projectile of claim 1, wherein at least some of said vanes are incused beneath said head portion surface.

5. The air arm projectile of claim 1, wherein at least some of said vanes are raised above said head portion surface.

6. The air arm projectile of claim 1, wherein said vanes are circumferentially symmetrical in cross-section.

7. The air arm projectile of claim 1, wherein said vanes are circumferentially asymmetrical in cross-section.

8. The air arm projectile of claim 1, wherein said vanes are substantially notch shaped, comprising substantially planar sidewalls.

9. The air arm projectile of claim 1, wherein said vanes define curvilinear sidewalls.

10. The air arm projectile of claim 1, wherein said vanes are integrally formed with a homogeneous material composition making up said projectile.

11. The air arm projectile of claim 1, wherein said projectile has a characteristic center of gravity axially positioned intermediate leading and trailing ends of said vanes.

12. The air arm projectile of claim 1, wherein the forward end of said skirt portion is conjoined with said head portion to form a radially outwardly facing forward guide surface, said forward guide surface having a nominal diameter equal to or exceeding the maximum nominal diameter of the head portion.

13. The air arm projectile of claim 12, wherein the rearward end of said skirt portion forms a radially outwardly facing rear guide surface, said rear guide surface having a nominal diameter substantially equaling the nominal diameter of said forward guide surface and disposed in axial alignment therewith, the rearward end of said skirt portion further forming a radially outwardly directed abutment collar operative, prior to discharge of the air arm, to limit axial displacement of the projectile in at least one axial direction within the breech of the air arm.

14. The air arm projectile of claim 1, wherein said projectile has a characteristic substantially continuously recurved profile comprising a generally convex segment defined by said head portion and a generally concave segment defined by said skirt portion.

15. The air arm projectile of claim 1, wherein said body of revolution is molded from relatively dense metallic material or alloy.

16. The air arm projectile of claim 1, wherein said body of revolution is molded from a composition consisting of a major weight proportion of a dense material of a particulate form loading a matrix of a minor weight portion of a resinous binder.

17. The air arm projectile of claim 1, wherein the projectile has a characteristic head diameter of about 4.2 mm and a trailing edge diameter of about 4.65 mm.

18. The air arm projectile of claim 1, wherein the axial length of said skirt portion equals or exceeds the axial length of said head portion.

19. A projectile for an air arm molded as a body of revolution about a longitudinal axis, said projectile comprising:

a head portion dimensioned for free sliding in the bore of an air arm;

a skirt portion of frusto-conical shape integrally formed with said head portion from common homogeneous material, said skirt portion including a rearward end dimensioned to be in interference fit with said bore and a forward end joined with said head portion in a reduced diameter waist, the frustum being shell-walled and having a central recess opening to the rear and extending forwardly into the head portion, wherein said head portion has a parabolic outer surface and said skirt portion has a hyperbolic outer surface, said head portion outer surface and said skirt portion outer surface having a common nominal diameter dimension at a point of transition there between to effect a smooth transition in a direction along said longitudinal axis; and means for inducing rotation of said projectile about its longitudinal axis as it traverses a line of trajectory after being discharged from said air arm, said means for inducing rotation comprising one or more vanes formed substantially symmetrically on the outer surfaces of said head portion and the reduced diameter waist portion of said skirt portion, each vane extending axially in a helix configuration which varies in pitch along its axial extent, and at least some of said vanes incused within said head portion, wherein said projectile has a characteristic center of gravity located within the head portion along the longitudinal axis at a point intermediate the forwardmost and rearward most ends of said vanes formed on the outer surface of said head portion, and wherein the axial length of said skirt portion equals or exceeds the axial length of said head portion.

20. In a projectile for an air arm molded as a body of revolution about a longitudinal axis comprising a head portion dimensioned for free sliding in the bore of an air arm and a skirt portion of frusto-conical form of which the rearward end is dimensioned to be in interference fit with said bore and the forward end is joined with the head portion in a reduced diameter waist, the frustum being shell-walled and having a central recess opening to the rear and extending forwardly into the head portion, an improvement wherein said projectile has an external surface form characterized by a parabolic head which smoothly transitions axially into a hyperbolic skirt, said projectile further comprising means operative to induce continued rotation of said projectile about its axis as it traverses a line of trajectory after being discharged from said air arm, wherein said means operative to induce continued rotation comprises one or more vanes formed substantially symmetrically on the outer surface of said head portion, each vane extending axially in a helix configuration, and wherein one or more of said vanes extend axially along at least a portion of the outer surface of said skirt portion.

21. In a projectile for an air arm molded as a body of revolution about a longitudinal axis comprising a head portion dimensioned for free sliding in the bore of an air arm and a skirt portion of frusto-conical form of which the rearward end is dimensioned to be in interference fit with said bore and the forward end is joined with the head portion in a reduced diameter waist, the frustum being shell-walled and having a central recess opening to the rear and extending forwardly into the head portion, an improvement wherein said projectile has an external surface form characterized by a parabolic head which smoothly transitions axially into a hyperbolic skirt, said projectile further comprising means operative to induce continued rotation of said projectile about its axis as it traverses a line of trajectory after being discharged from said air arm, wherein said means operative to induce continued rotation comprises one or more vanes formed substantially symmetrically on the outer surface of said head portion, each vane extending axially in a helix configuration, and wherein said vanes have a characteristic pitch which varies along the axial extent thereof.

* * * * *